US011561059B2

(12) United States Patent
Reis-Green et al.

(10) Patent No.: US 11,561,059 B2
(45) Date of Patent: Jan. 24, 2023

(54) FIREARM SOUND SUPPRESSOR BAFFLES

(71) Applicants: Austin Reis-Green, Watertown, WI (US); Evan Reis-Green, Juneau, WI (US)

(72) Inventors: Austin Reis-Green, Watertown, WI (US); Evan Reis-Green, Juneau, WI (US)

( * ) Notice: Subject to any disclaimer, the term of this patent is extended or adjusted under 35 U.S.C. 154(b) by 1 day.

(21) Appl. No.: 16/948,036

(22) Filed: Aug. 28, 2020

(65) Prior Publication Data

US 2021/0396485 A1 Dec. 23, 2021

Related U.S. Application Data

(60) Provisional application No. 63/040,841, filed on Jun. 18, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 2,191,648 A * 2/1940 Jules ..... F41A 21/36 89/14.3
7,308,967 B1 * 12/2007 Hoel ..... F41A 21/30 181/255
8,100,224 B1 * 1/2012 Olson ..... F41A 21/30 181/267
8,807,272 B2 * 8/2014 Bladen ..... F41A 21/30 89/14.3
8,991,552 B2 * 3/2015 Latka ..... F41A 21/30 89/14.4
9,102,010 B2 * 8/2015 Wilson ..... F41A 21/36
9,500,426 B2 * 11/2016 Salvador ..... F41A 21/30
10,054,382 B2 * 8/2018 Palu ..... F41A 21/30
10,267,586 B1 * 4/2019 Marfione ..... F41A 21/30
10,330,418 B2 * 6/2019 Washburn, III ..... F41A 21/30
10,458,739 B2 * 10/2019 Smith ..... F41A 21/30
10,724,817 B2 * 7/2020 Miele ..... F41A 21/30
11,255,623 B2 * 2/2022 Kras ..... F41A 21/30
11,280,571 B2 * 3/2022 Miller ..... F41A 21/30
2012/0152093 A1 * 6/2012 Koumbis ..... F41A 21/30 89/14.4
2016/0018179 A1 * 1/2016 Morris ..... F41A 21/30 181/223
2020/0025494 A1 * 1/2020 Parker ..... F41A 21/30
2020/0182578 A1 * 6/2020 Turnblom ..... F41A 21/30
2021/0341247 A1 * 11/2021 Bowers ..... F41A 21/30
2021/0381791 A1 * 12/2021 Magee ..... F41A 21/30
2022/0018623 A1 * 1/2022 Borunsky ..... F41A 21/30

* cited by examiner

*Primary Examiner* — Joshua E Freeman
*Assistant Examiner* — Benjamin S Gomberg
(74) *Attorney, Agent, or Firm* — Dunlap Bennett & Ludwig, PLLC

(57) ABSTRACT

A baffle for silencers which are adapted to reduce system heating, better protect shooter hearing, and reduce the amount of combustion gas vented in the shooters face and eyes during the use of gas operated, self-loading firearms.

10 Claims, 4 Drawing Sheets

FIREARM SOUND SUPPRESSOR BAFFLES

CROSS-REFERENCE TO RELATED APPLICATION

This application claims the benefit of priority of U.S. provisional application No. 63/040,841, filed 18 Jun. 2020, the contents of which are herein incorporated by reference.

BACKGROUND OF THE INVENTION

The present invention relates to firearm suppressors and, more particularly, a firearm sound suppressor producing low shooters ear sound signature.

Silencer customers, both military and consumer, have become more aware of shooter hearing loss and exhaust gas exposure in recent years. Preceding this, the atmosphere was a Vietnam war emphasis. Traditional testing methods involving locating a class 1 sound meter with ~20 us peak rise time, at 1 meter distance at 90 degree angle of incidence to the firearm muzzle, to measure the extent to which the sound of firing can be reduced at the muzzle of the firearm. This original emphasis was on the use of the silencer for concealment of the friendly soldier's firing position from enemy auditory observation. More recently, military solicitations have asked for silencers which emphasize OSHA-style protection of the shooters hearing, or reduction of firearm exhaust gas exposure, which is a respiratory concern. In the consumer market, consumers have become more interested in how a silencer will improve their personal ear comfort during firing or improve their protection from hearing loss. This has helped move the mindset from the post-Vietnam war era emphasis of shooter concealment, toward shooter hearing and health protection. The modern shooter, both military and consumer, desires a sound suppressor which is high performance at both muzzle and breech, when used with auto-loading firearms.

This invention pertains to novel methods of porting silencer baffles, and for that reason, it makes sense to look at ported designs—even those that were not ported specifically for the currently popular respiratory and auditory health reasons stated above. In U.S. Pat. No. 951,770, James Miller teaches a silencer for engines, with a central bore and coaxial (tube with annular chamber between tubes) design. In the U.S. Pat. No. 951,770 design, the baffle spacers have round ports 7, 18, and 19, placed radially in the side wall of the spacer, allowing gas to travel out of the baffle system into an annular chamber 17. This type of coaxial silencer design exposes more surface area to heat, causing poor durability, and also allows gas to exit the baffles, pass through the ports, and travel un-obstructed through the annular chamber 17, diminishing sound reduction. In U.S. Pat. No. 4,907,488 Oswald Seberger utilized parabolic disc baffles with round holes in a portion of the baffle between the interior wall of the tube and the central aperture, and he believed that sound could be delayed in relation to sound moving through the central bore hole, and caused to collide and cause phase cancellation. His silencer became the basis for the majority influence of similar ported suppressors and can be seen in Surefire LLC's U.S. Pat. No. 7,594,464B2 "Sound Suppressors for Firearms" which mentions Seberger. These circular ports arrayed in circular patterns laid in between the central bore and outside diameter of the frusto-conical baffle are also present in Sig Sauer Inc's current SRD silencer lineup visible in their U.S. Pat. No. 9,464,857B2, and U.S. Pat. No. 10,234,229B2 patents, so obviously Oswald Seberger's mid diameter ring of circular holes has been integrated into many silencers. In US20150338183A1 Joeseph D. Salvador incorporated a stepped frusto-conical baffle, with radial slots machined into the steps of the baffle. The radial slots direct gas from the receiving side, through the baffle side wall, toward the bore-line of the suppressor, which is an undesirable flow pattern for a silencer to have. Pressure concentrates in the center of the suppressor tube without encouragement, allowing excessive sound to leave the muzzle aperture. In U.S. Pat. No. 8,516,941B1 Russell Oliver teaches a very unique suppressor formerly sold by OSS Suppressors LLC. The OSS suppressor modules in the drawings show patterns of prior art porting in the modules, between the periphery and the bore axis of the assembly. These suppressors were very muzzle loud, ~8-10 DB's louder than competitive designs. The OSS octagonal silencers were also twice as long and heavy as a modern silencer, despite being manufactured from lightweight titanium. The octagonal tubes of these early OSS silencers failed under harsh use as a result of hoop strength not favoring a non-cylindrical tube housing. OSS abandoned the U.S. Pat. No. 8,516,941B1 design for a more conventional round tube profile more recently, and our testing of their current silencers showed them to be substantially above 140 DB at the shooter's ear with standard velocity ammunition, and still ~7-10 DB louder than competitive designs at the muzzle. In U.S. Pat. No. 10,088,259B2, Surefire teaches a system of laser welded sound suppressor construction. Their rectangular vents 124 are described to direct combustion gasses radially from expansion chamber 122, into the outer annular space (coaxial chamber) 118, surrounding the baffle stack at which point the gasses can move longitudinally in the annular space, which is similar in function to James Miller's U.S. Pat. No. 951,770 in that regard. This coaxial chamber is undesirable as it does not allow the spacer/baffle elements to reinforce the tube housing. Surefire talks about obvious coaxial silencer heat soaking failure issues formerly present in the design, and adds an extraneous element 120 blast deflector to prevent a "blowout" of the wall of a now protected small area of the housing, which of course could be reinforced by the baffle stack itself, but for the existence of the annular space 118.

In light of the above, it is obvious that there is a need for silencers which reduce system heating, and better protect shooter hearing, and reduce the amount of combustion gas vented in the shooters face and eyes during the use of gas operated, self-loading firearms.

SUMMARY OF THE INVENTION

Novel methods of porting and turbulence generation are provided for reducing shooter's ear sound signature, and obtaining performance increase beyond that of coaxial silencers, without resorting to the compromises of increased weight and heat generated per round, reduced strength, and increased component complexity found in coaxial chambered silencer design. The baffles provided support welded suppressors, as well as welded tubeless suppressors such as seen in FIG. 1 of the inventor's previous U.S. Pat. No. 9,239,201B1 "Firearm suppressor" and also user maintainable suppressors of the types found in the inventor's previous U.S. Pat. No. 9,816,773B1 "Spring detent retained end cap for a firearm suppressor" and U.S. Pat. No. 10,330,417B2 "User configurable and maintainable firearm suppressor".

In one example embodiment a sound suppressor for a firearm includes a cylindrical housing with first end comprising a receiving bore and a second end comprising a discharge bore; a plurality of frusto-conical baffles of the type found in inventor's U.S. Pat. No. 9,239,201B1 within the internal bore, at least three of which feature a plurality of convex-convex (or "biconvex profile", lens shaped) ports along its basal peripheral edge. Note, that in certain embodiments, though the cutout (of the base) that defines the port may by itself be described as a plano-convex cut, the resulting port (see FIG. 1) further defined by the inner diameter of an operatively associated spacer if viewed in a bottom plan view would appear as biconvex, or "biconvex profile", as illustrated in FIG. 7. In other embodiments, the cut of the cutout may be itself biconvex. In another example the frusto-conical baffles with biconvex base ports feature a novel non-truncated apex aperture frusto-conical baffle with elliptical sidewall port in the frusto-conical sidewall between the apex and base of the cone.

In one aspect of the present invention, a firearm suppressor baffle including the following: a frusto-conical sidewall comprising an apex having an axial bore and a base opposite the apex, wherein the apex and the base are interconnected by the frusto-conical sidewall; an annular spacer defined by an inner diameter and an outer diameter; the annular spacer attached to, or supportive of, or otherwise operatively associated with a periphery of the base at the inner diameter or between the inner diameter and the outer diameter; and a plurality of biconvex ports spaced apart along said periphery, wherein each biconvex port forms an opening between said periphery and said inner diameter, whereby motion of exhaust gasses through said firearm suppressor baffle are facilitated, wherein each opening includes a cutout of said inner diameter, wherein each cutout intersects a portion of said outer diameter, and wherein the apex comprises a semi-circular cut from the sidewall into the axial bore, forming a semi-circular notch.

In yet another aspect of the present invention, comprising an elliptical or obround shaped sidewall port exists between the apex of the cone and the base. wherein a circumference of the apex is undivided, and further including a radial alignment protrusion at the base.

These and other features, aspects and advantages of the present invention will become better understood with reference to the following drawings, description and claims.

DETAILED DESCRIPTION OF THE INVENTION

Figure 1:
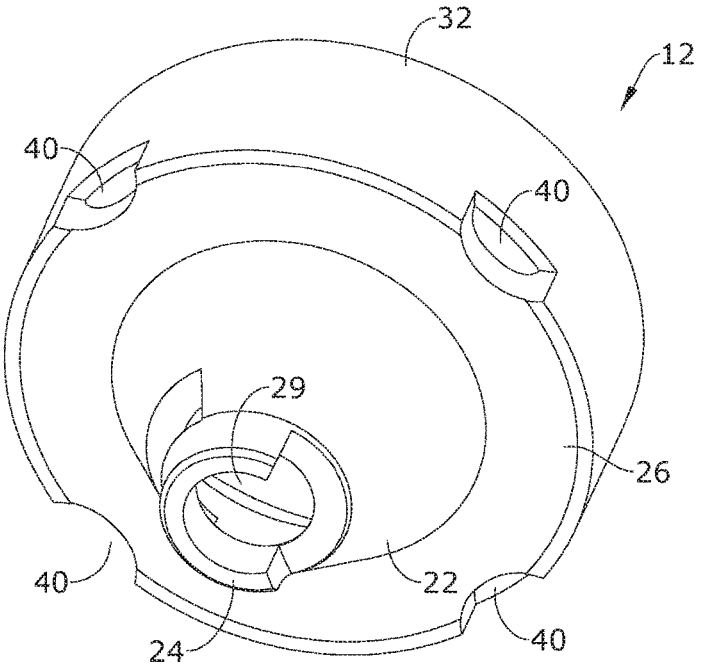
FIG. 1 is a perspective view of an exemplary embodiment of a baffle having four peripheral face ports of the present invention.
Figure 2:
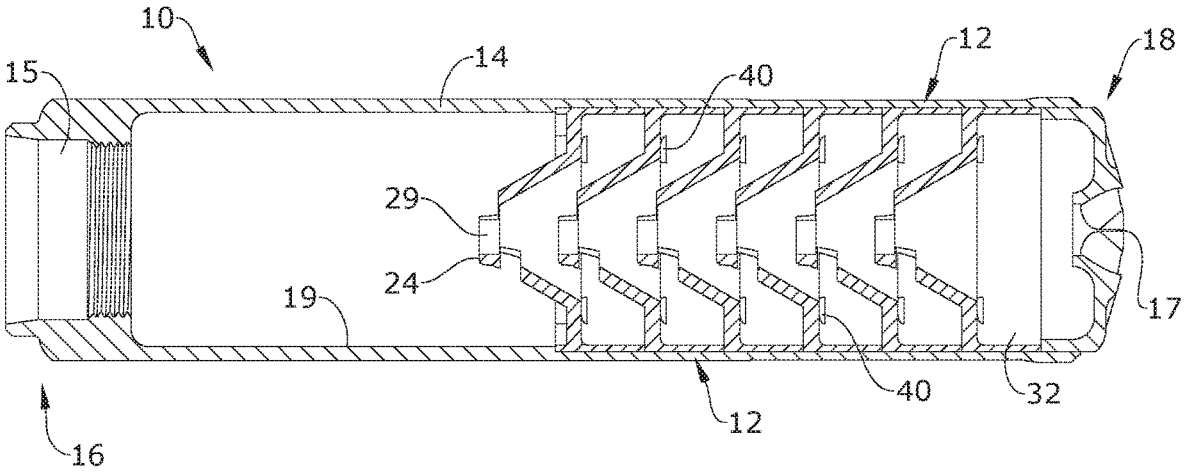
FIG. 2 is a cross-section view of an exemplary embodiment of the present invention, illustrating a six-baffle 5.56 mm suppressor installed with the baffles of FIG. 1.
Figure 3:
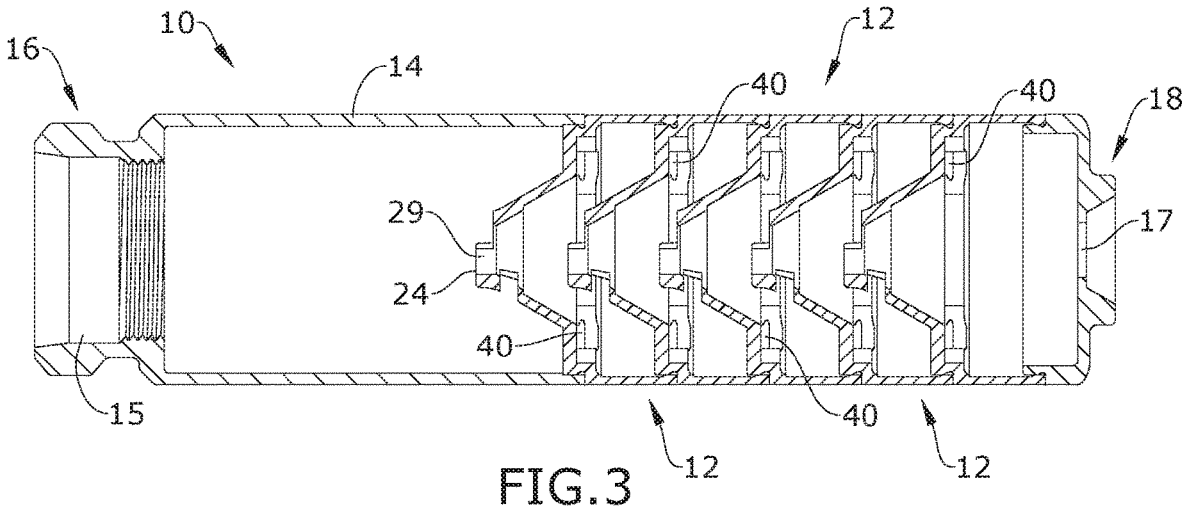
FIG. 3 is a cross-section view of an exemplary embodiment of the present invention, illustrating a tubeless welded five-baffle 5.56 mm suppressor installed with the baffles of FIG. 4.
Figure 4:
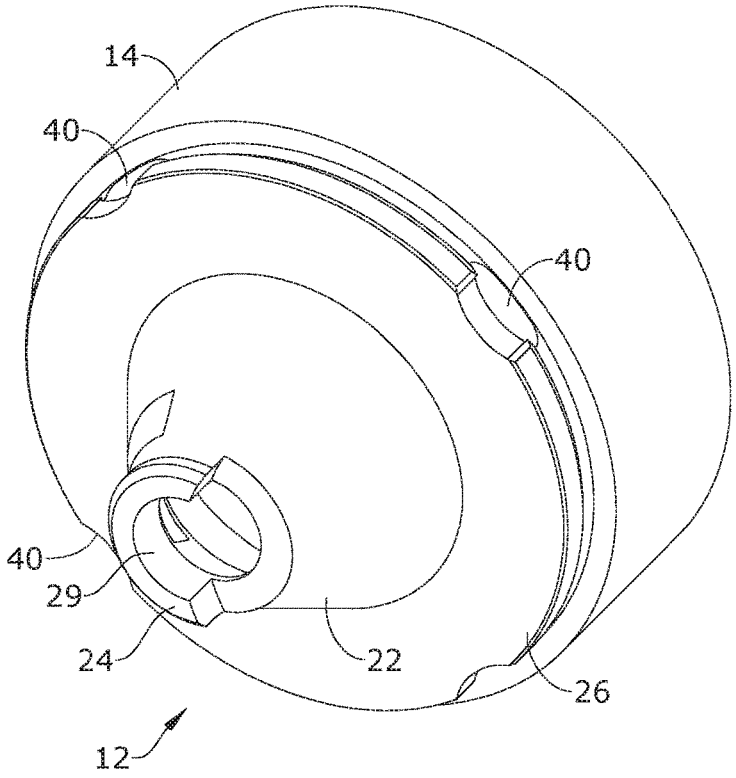
FIG. 4 is a perspective view of an exemplary embodiment of a single, welded baffle of the present invention.
Figure 5:
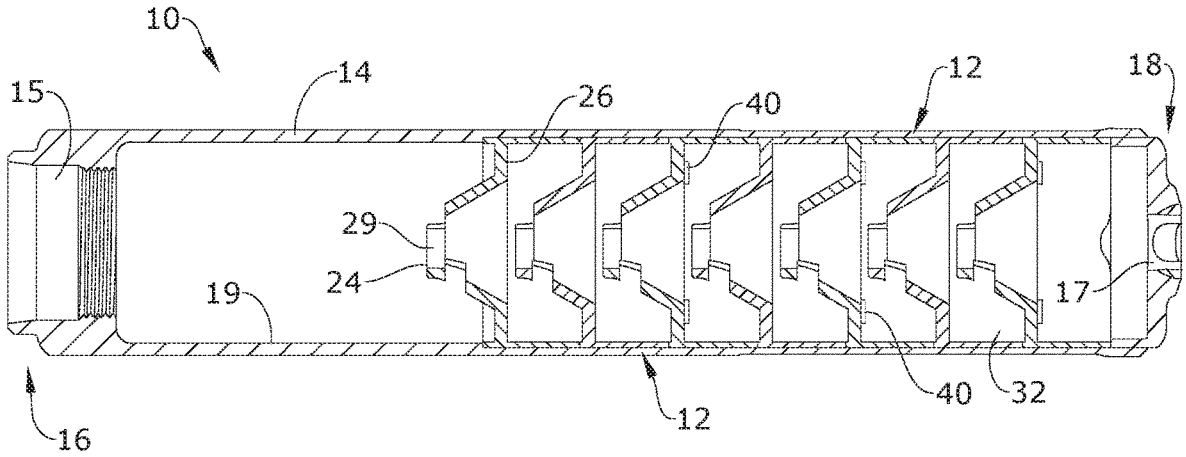
FIG. 5 is a cross-section view of an exemplary 7.62 mm embodiment of the present invention, illustrating a seven-baffle configuration.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides baffles for silencers which reduce system heating, and better protect shooter hearing, and reduce the amount of combustion gas vented in the shooters face and eyes during the use of gas operated, self-loading firearms.

Referring to FIGS. 1 through 8 the present invention includes a firearm suppressor 10 with baffles 12 featuring novel performance enhancing biconvex or lens shaped ports 40 on the peripheral edge of the forward face of the base 26 of the baffles 12. The suppressor 10 includes a cylindrical body 14 having first end 16 and a second end 18 opposite the first end 16. The cylindrical body 10 includes an internal bore 19. The first end 16 includes a receiving bore 15. The second end 18 includes a discharge bore 17. The bores, 15, 17, 19 align with one another.

The present invention further includes a plurality of baffles 12 secured within the internal bore 19. Each of the baffles 12 include a frusto-conical sidewall 22 having an apex 24 opposite a base 26. The apex 24 includes an axial bore 29 and is disposed towards the receiving bore 15 when operatively associated with the suppressor 10. The base 26 is disposed toward the discharge bore 17.

A plurality of baffles 12 have a plurality of biconvex ports 40 on a basal portion of the face near a peripheral edge of the profile located near to the tube's internal peripheral bore 19. The suppressor 10 may be attached to a firearm via a mating thread or mating connector such as a firearm barrel muzzle device adapter in the silencer receiving bore 15. Each baffle 12 can be provided with an axial bore 29 large enough to accommodate the passage of the projectile fired from a host firearm. Each axial bore 29 in each baffle 12 can be in coaxial alignment so that a projectile fired from a firearm can pass unobstructed through the receiving bore 15, the internal bore 19, and the axial bores 29 of the plurality of baffles 12 before exiting the discharge bore 17. The plurality of baffles 12 may be integral with the cylindrical body, 10 or formed separately and inserted into the cylindrical body, 10.

As illustrated in FIGS. 2, 3, 5, 6, and 7, each baffle 12 may include an annular spacer 32. The annular spacer 32 may be attached to the base 26 and may be substantially perpendicular to the base 26. The baffles 12 may be stacked or welded together and inserted within the cylindrical body 14 so that the annular spacers 32 are joined or resting against one another. The baffles 12 can be formed by machining, casting, molding, 3D metal printing, or stamping, and are manufactured so as to ensure a precise fit between the outer circumference of the annular spacer 32 and the inner circumference of the internal bore 19. By closely fitting the annular spacer 32 to the internal bore 19 expanding gasses, combustion by-products, and sound energy can be largely prevented from passing between the annular spacer 32 and the internal bore 19 thereby reducing heat generated per round, while allowing the suppressor 10 to suppress noise and muzzle flash. Further, the baffles 12 may be spaced apart by the spacers 32 which may be integral or separate components.

The plurality of ports 40 of the present invention are biconvex or lens shaped openings on a peripheral edge of the basal profile of the face of baffles 12. Their location on the peripheral edge in close proximity or tangent to internal bore 19 allows the apertures to have a more ideal shape and location for sound suppressor function compared to traditional drilled or stamped holes not on peripheral edge, which appear in many prior art designs. The cross sectional width of these ports is ~0.012 inch to approximately 0.055 inch at their maximum width but their length along the peripheral edge can be much longer, allowing one port of the invention to have high velocity volumetric flow (greater than many prior art holes of similar cross sectional width, which are more difficult and costly to manufacture, and more prone to fouling), yet small enough to have similar combustion flame mitigation properties. This allows ports 40 to resist fouling and to encourage and allow substantial increase in system flow in the under-utilized periphery of the inside diameter of the internal bore 19. Part of the operating theory of the suppressor 10 is to extinguish combustion so that the exhaust gases cease to expand in volume. Flame has difficulty passing through thin apertures, and long, thin peripheral ports can mitigate the passage of flame, while allowing extinguished combustion gases to pass into chambers ahead of the combustion gasses, reducing the continued combustion and expansion of exhaust gasses traveling through the baffles 12 behind the projectile. The bi-convex shape of the peripheral ports 40 increases turbulence and vorticity. In operation, the bi-convex peripheral ports 40 inject high velocity streams of exhaust gas diagonally and longitudinally from traditionally lower pressure regions of the periphery of the internal bore 19 and periphery of baffle base 26 where the traditional lack of exhaust flow paths typically reduces access. The monopolization of peripheral volume and additive turbulence and vorticity at the base 26 and baffle sidewall 22 created by high velocity flow—through the biconvex ports 40—assists in reducing gas pressure and velocity along a path, generally traveling through sequential baffled chambers at said ports 40 toward and exiting the discharge bore 17 of the silencer 10.

When the action of an auto-loading host firearm opens during the firing sequence, the presence of peripheral ports 40 and encouragement of peripheral flow also provide novel improvement to system function. This peripheral flow enhances the ability of the frusto-conical baffle base to baffle gas that would otherwise rapidly travel backward through the funnel shaped geometry created by the frusto-conical system, manifesting itself in high ejection port sound, and polluted air—vented into the face of the operator of the firearm. The ports 40 influence the silencer 10 to perform equal to or better than a coaxial chambered, flow through silencer in terms of reducing shooter hearing risk and improving the quality of air in the vicinity of the shooter's face and eyes, without substantial increase in muzzle sound pressure levels. The important low pressure, peripheral profile baffle face edge location of ports 40 near or tangent to internal bore 19 allow the ports 40 to derive flow-through function, while increasing rather than harming muzzle sound reduction. The peripheral baffle face ports 40 substantially drop sound pressure in the vicinity of the firer's ears without requiring the inclusion of extraneous walls, parts, and baffling features found in coaxial designs. The lack of extraneous walls and baffling features promote lighter system weight and reduce heat soaking of the silencer 10 during the process of creating the desired level of performance, while influencing the desired motion of exhaust gases.

Figure 6:
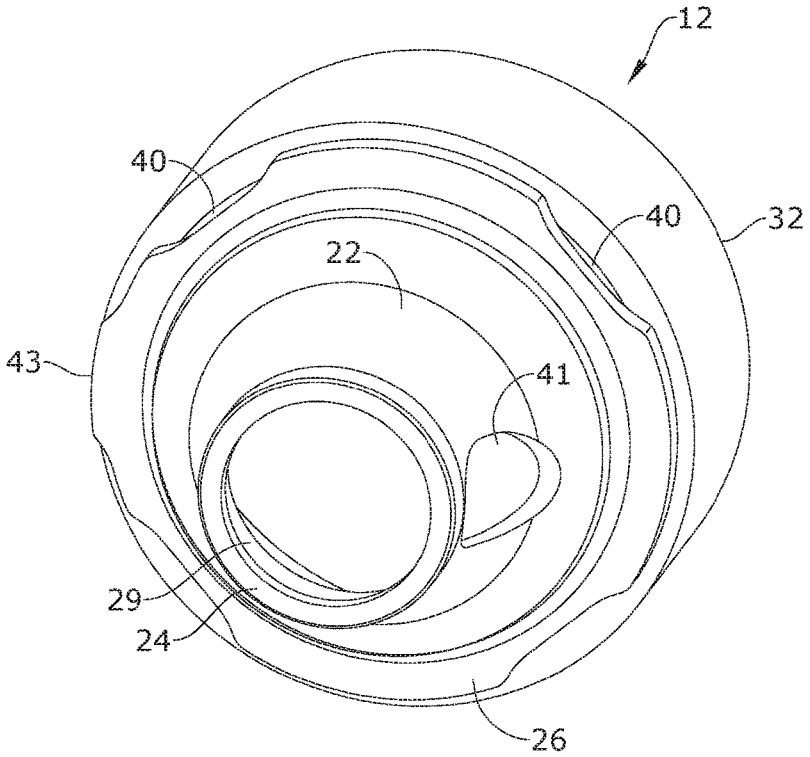
FIG. 6 is a perspective view of an exemplary embodiment of a baffle having four peripheral face ports illustrating a novel non-truncated apex aperture frusto-conical baffle with elliptical sidewall port in the frusto-conical sidewall between the apex and base of the cone.
Figure 7:
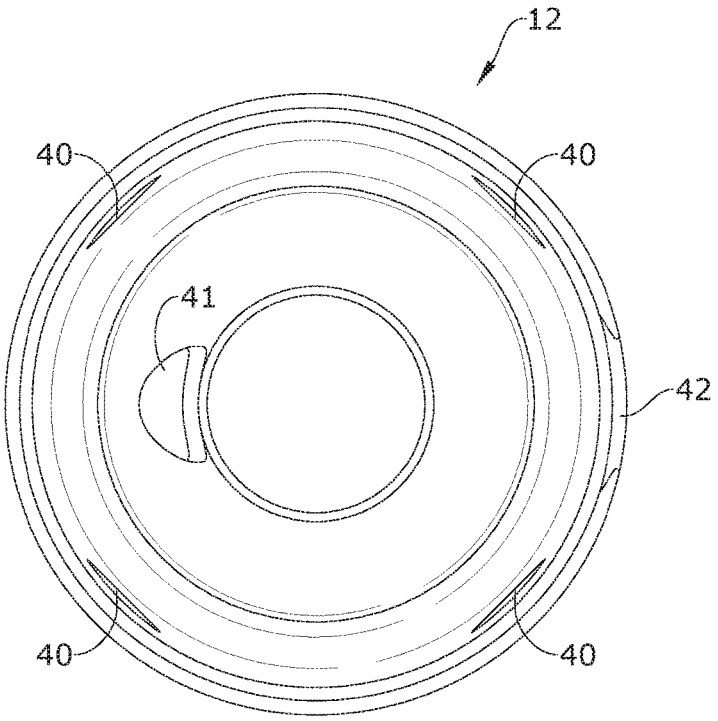
FIG. 7 is a bottom plan view of FIG. 6.
Figure 8:
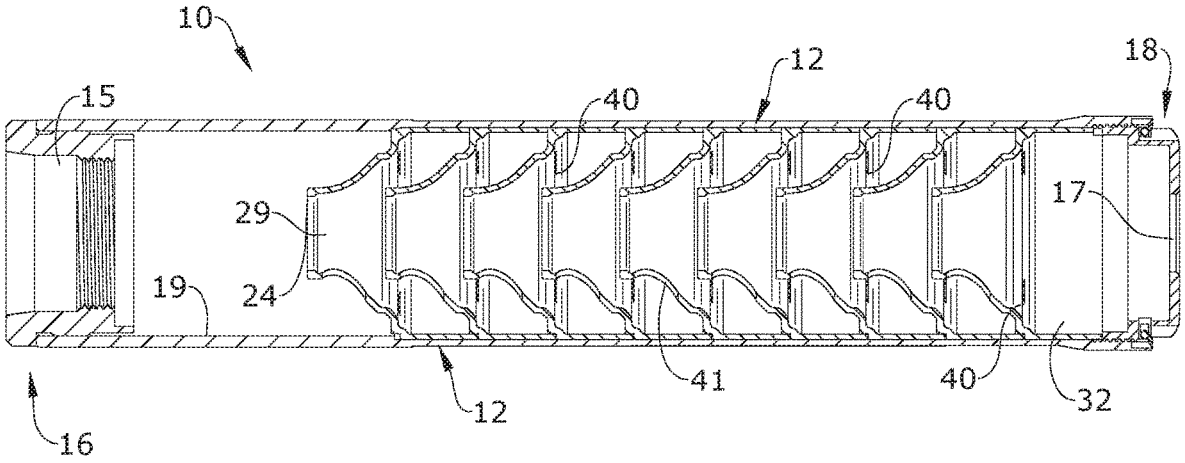
FIG. 8 is a cross-section view of an exemplary embodiment of the present invention, illustrating a spring-retained cap suppressor with a plurality of the baffles shown in FIGS. 6 and 7.

Regarding FIGS. 6, 7, and 8, in another embodiment the baffles 12 include recess 42 and protrusion 43 allowing baffles 12 to stack together in a desired orientation for use in user maintainable suppressors such as those found in U.S. Pat. No. 10,330,417B2, and U.S. Pat. No. 9,816,773B1. The baffles 12 may also include novel elliptical shaped port 41 in frusto-conical baffle face sidewall 22 allowing off-axis flow, while maintaining a full circumferential apex aperture 24. This novel elliptical port 41 does not have to be located on the apex of the baffle, truncating the apex, as in prior art systems, thereby permitting the port 41 to be adjusted in location between the base 26 and apex 24 as desired for objective system performance. The full circumferential apex aperture 24 strengthens the baffles, 12 and reduces the prior art keyhole enlarging of the bore aperture from a common, truncating, half round shear cut, which may negatively affect point-of-impact shift, or allow gas to flow straight through the system, around the projectile, without baffle interaction. This full circumferential apex aperture 24 eliminates unsupported, elastic compression of the rather thin walled baffles which would otherwise typically have a truncated cone wall at aperture 24 which would cause this elastic compression during the pressurization of the firing cycle. In this way the novel elliptical port 41 prevents or minimizes the bore changing shape, size, or location during routine cyclical pressurization. The full circumferential apex 24 with its strong round aperture, also in this way, reduces risk of bullet contact to baffles 12 as the projectile passes through the silencer 10. Another notable improvement in the non-truncated apex, cone baffle system is a reduction of point of impact shift in low velocity applications where traditional truncated cones have typically caused point of impact shift due to a phenomenon causing the projectile to want to center itself in the primary flow aperture, which in thin wall truncated apex baffles is not a round aperture.

EXAMPLES

To compare the silencer of the present invention to the silencer of the preferred embodiment of the inventor's U.S. Pat. No. 9,239,201 B1 patent, the inventor used what is universally considered to be the best system available in the world for testing firearms impulse noise. Testing equipment was comprised of Bruel and Kjaer "Pulse" (LAN-XI) 3052-A-030 with 4944-A microphone transducers at 1 Meter left of the unsuppressed muzzle, as well as 4944-A microphones mounted on ear protectors in close proximity to the positions of shooters anatomical right and left ear. Bruel and Kjaer 7963—N—Pulse Impulse Noise Evaluation Software was used for the reporting of the A-weighted, peak hold data, at maximum 262 KHZ sampling speed. Sound engineers from B&K have estimated peak rise time of this system to be ~4.5 microseconds—several orders of magnitude faster than class 1 handheld meters—resulting in very little clipping of peak sound, affording superlative accuracy.

The Recce 5, a 6 baffle, 5.56 mm silencer representing an exemplary embodiment of the U.S. Pat. No. 9,239,201B1 patent was tested on a 16" barrel Ar-15 using M193 55 grain ammunition. A 5 round string averaged 136.7 DB (Decibel) left ear, 139.5 DB right ear, 132.7 DB 1 meter left of the muzzle. The silencer with 6 baffles of the U.S. Pat. No. 9,239,201B1 patent were then modified with the addition of 4 ports on the peripheral edge of the basal face of the baffles, and the same rifle was tested to the same standard, with 5 rounds of the same lot number of ammunition. The silencer of the new invention produced averaged values of 131.9 DB left ear, 135 DB right ear, and 132.5 DB 1 meter left of the muzzle, showing a 4.8 DB drop left ear (a 42% reduction of sound pressure), 4.5 DB drop right ear (a reduction of 40% of sound pressure), and a minor increase in muzzle performance. Video analysis of smoke signature (velocity and distance), showed a substantial reduction of velocity of gas exiting the action of the firearm. The gas which had formerly blown outward in an approximate 24" visible radius from the chamber, now only produced an approximate 4" radius. Shooters noticed dramatic reduction in tangible smell of gas and burning exhaust gas in the eyes was totally eliminated.

This was especially noteworthy as the U.S. Pat. No. 9,239,201B1 patent suppressor already had substantially lower ear noise than silencers featuring the generally predominant public domain baffle in use on the consumer market with many companies, such as baffles 30 seen in FIG. 3 of the U.S. Pat. No. 10,330,417B2 "User configurable and maintainable firearm suppressor". The best shooter ear performing competitor silencer we were able to find to test our silencer against was the Surefire LLC SOCOM 556 RC2 model featured in U.S. Pat. No. 10,088,259B2 which won the largest recent historical military contract in silencers—the SOCOM contract for Special Operations. When tested against the Surefire LLC. U.S. Pat. No. 10,088,259B2 patent suppressor, the silencer with six baffles of the U.S. Pat. No. 9,239,201 B1 patent, with four ports added on the periphery of each baffle, produced sound pressure level 1.44 DB more quiet at the right ear, 4.1 DB more quiet at the left ear, and 3.04 DB more quiet muzzle, on a 16 inch barrel. This is noteworthy because we are outperforming the 22 component baffle and spacer assembly of the coaxial chambered U.S. Pat. No. 10,088,259B2, with six far easier to assemble components, without resorting to the inferior coaxial design which increases weight, adds a fouling-prone chamber around the baffle system, and insulates the internal components from cooling due to this air space "annular expansion volume" 118 denoted in U.S. Pat. No. 10,088,259B2 FIG. 3, between baffles, spacers, and the external tube. Dueck also teaches that a function of his silencer is to reduce the temperature of exhaust gas. In physics energy is transferred, and in this case that involves heating the suppressor. The non-coaxial chambered design of the suppressor of the present invention reduces internal surface area exposed to heat and fouling by approximately 70% when compared to the Surefire, which reduces fouling deposited per round, and system heating per round fired. The Surefire suppressor is known to get so hot that it glows from heat during aggressive use, and the military is also interested in reducing visual light and thermal spectrum (heat) signatures. The Surefire system affords only radial motion of gas into a single long annular chamber [like Miller's U.S. Pat. No. 951,770 design], interacting with as few as four surfaces before leaving the system.

In greater detail, Surefire allows gas to exit the blast chamber radially and move as far forward as the last baffled chamber before leaving the system, where our system forces gas in a linear, or diagonal direction, through the peripheral edge of the baffle face, internal to each of the six baffles and the end cap. In our system the gas is forced to repetitively pass through sequential baffles, increasing turbulence and vorticity, allowing it to achieve superior backpressure and sound reduction, with only 29% of the component count, in a cooler operating, non-coaxial chambered, silencer of approximately identical length, identical 1.5 inch diameter, and three ounces lighter than the Surefire 556 RC2 silencer—the highest performance silencer previously designed, to the best of our knowledge of the current performance of products in our industry.

The present invention also embodies the baffles of FIGS. 6,7, and 8 having biconvex peripheral ports in conjunction with a novel elliptical frusto-conical sidewall port, which is adaptable to a pistol suppressor from our product line, which we tested the 9 mm pistol suppressor to find what sound reduction could be achieved by applying the technology to subsonic projectile application pistol baffles. We comparison tested the control unit Revolution 9 suppressor from our product line developed in 2014, without peripheral ports, using 147 grain standard velocity ammunition, fired through a Smith and Wesson M&P 9 mm, M2.0 pistol. Using the previously mentioned Bruel & Kjaer system, we tested it with the original 9 baffles against the same silencer with just 8 biconvex baffle face peripheral edge ported, elliptical cone sidewall port baffles of this invention. We found that the replacement of the improved baffles reduced left ear signature by 5.54 DB, reduced right ear by 4.51 DB, and reduced muzzle signature by 3.28 DB. The average decrease of 4.44 DB for each location represented a reduction of ~39% of sound pressure.

We then tested the most recently developed major market competitor, the Gemtech/Smith and Wesson designed, Gemtech Lunar 9, which reached the market in January 2020, and found the Lunar 9 to be 5 DB's louder muzzle, 3 DB's louder right ear, and 1 DB louder left ear. We then tested the 2020 released, Lunar 9 suppressor, in the optional short configuration and found it to meter 142 DB across all three mic locations for a five-round average. Five-round average from the legacy 2014 Revolution 9 suppressor in the short configuration metered 144.9 DB left ear, 143.9 right ear, 132.4 muzzle. Replacing the six baffles, with five biconvex baffle face peripheral edge ported and the elliptical cone sidewall port baffles of the present invention, the Rev 9 short configuration of the invention produced 5 round averages of 135.1 left ear, 135.37 DB right ear, and 132.8 DB muzzle, bettering the 2020 Lunar 9 short configuration, at every location, by a wide margin. It was especially noteworthy that gas in the face and eyes was quite noticeable in the original Rev 9 short configuration control tested and were totally absent in the biconvex baffle face peripheral edge ported and elliptical sidewall port version.

In our similar Revolution 45 caliber baffle we were able to drop approximately 5.5 decibels at three microphone locations and ~48% of sound pressure at all tested locations by switching to the baffle of the invention in FIGS. 6,7, and 8, while also deleting the end baffle and reducing the overall component count. We then configured the Revolution 0.45 in the K configuration and found that we were able to derive a similar four decibel drop in this configuration, rendering the 6.75" silencer OSHA hearing safe (just below the 140 DB risk limit for impulse noise) at all three microphone locations. This silencer had previously been a short configuration sound performance market leader in the configurable silencer class, which we originally created in 2014 with the development of the Revolution silencer series.

It should be understood, of course, that the foregoing relates to exemplary embodiments of the invention and that modifications may be made without departing from the spirit and scope of the invention as set forth in the following claims.

What is claimed is:

1. A firearm suppressor baffle comprising:

a frusto-conical sidewall comprising an apex having an axial bore;

a base radially extending from the frusto-conical sidewall opposite the apex;

a plurality of biconvex lens-shaped ports spaced apart along an outer periphery of said base; and an annular spacer defined by an inner surface and an outer surface, the inner surface operatively associated with the outer periphery of said base.

2. The firearm suppressor baffle of claim 1, wherein each said biconvex lens-shaped port forms an opening between the outer periphery of said base and said inner surface of the annular spacer, whereby motion of exhaust gasses are facilitated.

3. The firearm suppressor baffle of claim 2, wherein each said opening includes a cutout of said inner surface.

4. The firearm suppressor baffle of claim 3, wherein each said cutout intersects a portion of said outer surface.

5. The firearm suppressor baffle of claim 1, wherein the apex comprises a semi-circular cut from the sidewall into the axial bore, forming a semi-circular notch.

6. The firearm suppressor baffle of claim 1, further comprising an elliptical or obround shaped sidewall port between the apex and the base.

7. The firearm suppressor baffle of claim 6, wherein a circumference of the apex is undivided.

8. The firearm suppressor baffle of claim 6, further comprising a radial alignment protrusion at the base.

9. The firearm suppressor baffle of claim 8, wherein the annular spacer includes a notch to receive a radial alignment protrusion of a subsequently stacked baffle.

10. A firearm suppressor comprising:

a cylindrical body having a first end and a second end, wherein the first end comprises a receiving bore, the second end comprises a discharge bore and the cylindrical body comprises an internal bore; and at least three of the firearm suppressor baffles of claim 1, wherein the plurality of biconvex lens-shaped ports of each said baffle are adjacent to an inner periphery of the cylindrical body.

* * * * *